United States Patent [19]

Merritt

[11] 4,368,780

[45] Jan. 18, 1983

[54] KICKOVER TOOL

[75] Inventor: David T. Merritt, Celina, Tex.

[73] Assignee: Otis Engineering Corporation, Dallas, Tex.

[21] Appl. No.: 292,781

[22] Filed: Aug. 14, 1981

[51] Int. Cl.[3] ..... E21B 23/03

[52] U.S. Cl. ..... 166/117.5; 166/240

[58] Field of Search ..... 166/117.5, 240

[56] References Cited

U.S. PATENT DOCUMENTS 3,876,001 4/1975 Goode ..... 166/117.5

3,891,032 6/1975 Tausch et al. ..... 166/117.5

*Primary Examiner*—Stephen J. Novosad

*Assistant Examiner*—Joseph Falk

*Attorney, Agent, or Firm*—Vinson & Elkins

[57] ABSTRACT

A kickover tool which has its tool carrier latched in aligned and kicked-over positions. The locator key is stopped during upward travel of the tool by engaging a muleshoe.

8 Claims, 6 Drawing Figures

KICKOVER TOOL

This invention relates to well tools and more particularly to kickover tools for landing and retrieving valves or other control devices from a side pocket mandrel.

Kickover tools are well known apparatus for landing and retrieving well control devices, such as valves, from side pocket mandrels.

The forerunner of the modern kickover tool is probably that shown in Fredd U.S. Pat. No. 2,948,341 in which for the first time a kickover tool was operated by engaging a key with a shoulder in the well and pulling up on a wireline to shift a tool carrier to kicked-over position.

Present day kickover tools are exemplified by the Yonker U.S. Pat. No. 3,837,398; the Goode U.S. Pat. No. 3,876,001; and the Moore U.S. Pat. No. Re. 29,870.

In the Yonker patent the tool carrier is latched in the kickover position until a shear pin is sheared permitting a sleeve to move and release the latch.

In the Goode patent a pair of opposing shoulders hold the tool carrier in aligned position until a shifting plunger is caused to move relative to the housing by a key carried by the plunger engaging the shoulder in the well. After the opposed shoulders have disengaged the tool carrier may be rotated to kicked-over position where it is releasably latched in this position.

In the Moore patent opposed shoulders prevent movement of the tool carrier to kicked-over position until the key carrying plunger disengages the shoulders on relative movement of the housing and plunger. The tool carrier is moved to kicked-over position by a spring which tends to hold the tool carrier in the kicked-over position.

An object of this invention is to provide a kickover tool with a simple two-position detent for latching the tool carrier of the kickover tool in either aligned or kicked-over position.

Another object is to provide a kickover tool as in the preceding object in which a simple spring loaded plunger may be carried either directly by the housing or indirectly by an actuating member associated with the housing.

Another object is to provide a kickover tool with a tool carrier and an associated detent in which the plunger of the detent and the tool carrier have confronting teeth thereon to latch the tool carrier in either aligned or kicked-over position.

Another object is to provide a kickover tool as in the preceding object in which a stop means is provided on the tool carrier and either the housing or the detent plunger to limit pivoting of the tool away from its kickover position to a position axially aligned with the housing.

Another object is to provide a locator key for a kickover tool which will engage only a muleshoe and will not hang up on a downwardly facing shoulder in a well.

Another object is to provide a locator key as in the preceding object in which the lug of the key which engages the surface of a muleshoe is limited in its rotational movement so that it can never rotate into a position in which it could hang and prevent free movement of the locator key through the well after the lug has been released and the tool is being withdrawn from the well.

Other objects, features and advantages of the invention will be apparent from the drawings, the specification and the claims.

In the drawings wherein an illustrative embodiment of this invention is shown and wherein like reference numerals indicate like parts;

Figure 1:
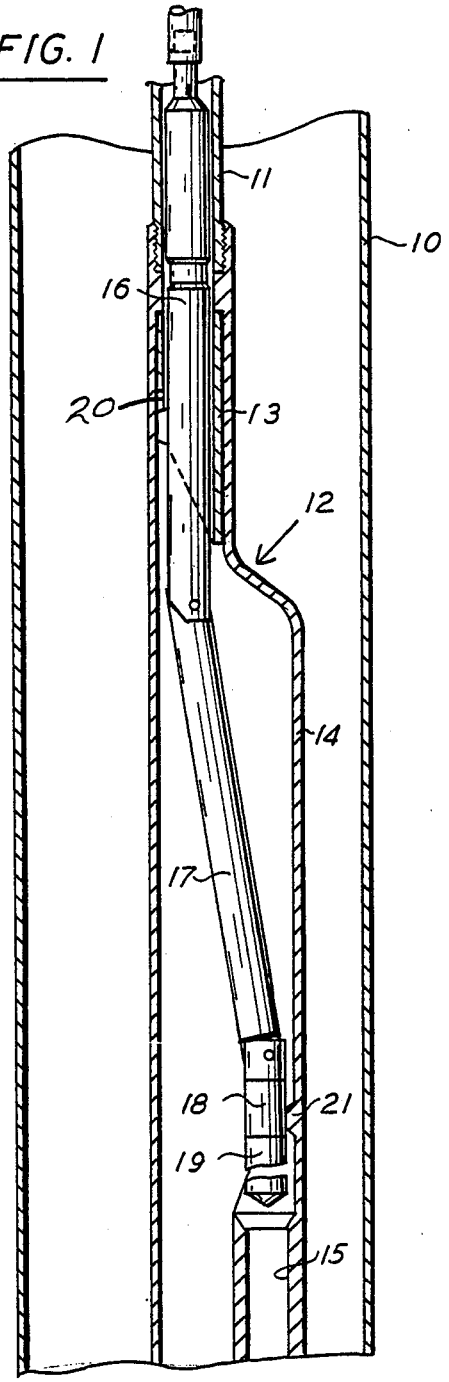
FIG. 1 is a sectional view through a segment of a well casing with a tubing and side pocket mandrel therein showing the kickover tool of this invention in elevation.

Referring first to FIG. 1, a section of a casing 10 within a petroleum well is shown to have suspended therein a well tubing 11. The tubing includes a side pocket mandrel indicated generally at 12. The mandrel 12 includes a conventional muleshoe 13, a belly 14, and a valve pocket 15 which are conventional in form.

Shown within the side pocket mandrel is the kickover tool of this invention in the kicked-over position; that is, with the main housing 16 of the tool in alignment with the bore through the tubing and with the tool carrier 17 latched in the kickover position in which it extends into the belly 14. The kickover tool carries a conventional latch shown schematically at 18 and a conventional valve 19, also shown schematically, being run into pocket 15 where the latch mechanism 18 will engage the latch flange 21 latching the valve 19 in pocket 15 to permit the kickover tool to be released from the latch 18 in the conventional manner and withdrawn from the hole. Alternatively, the kickover tool could carry a retrieving sub as is understood by those skilled in the art, and engage the latch 18 to retrieve the latch and gas lift valve from the valve pocket, all as will be understood by those skilled in the art.

Figure 2:
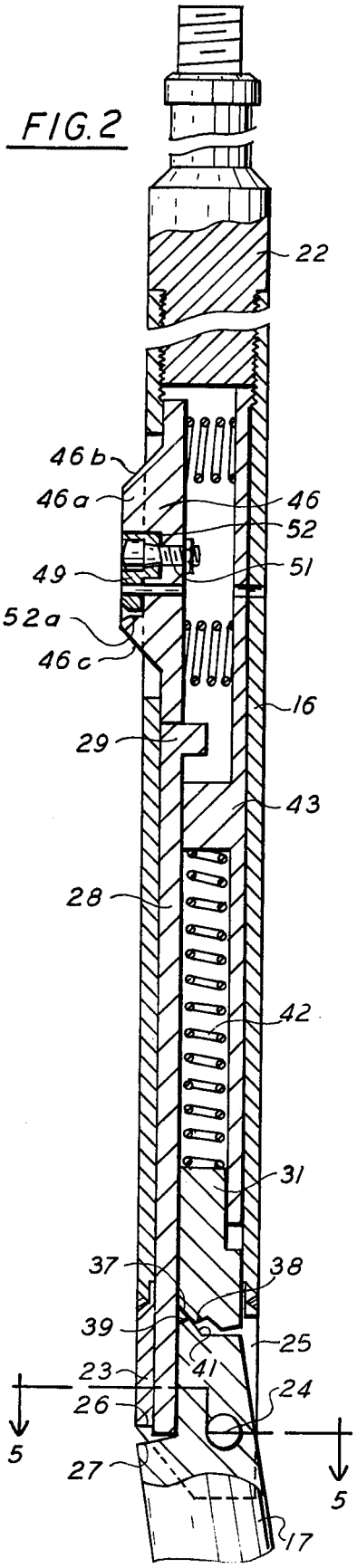
FIG. 2 is a view partly in elevation and partly in cross-section of a portion of the kickover tool shown in FIG. 1 with the tool carrier shown in kicked-over position.
Figure 3:
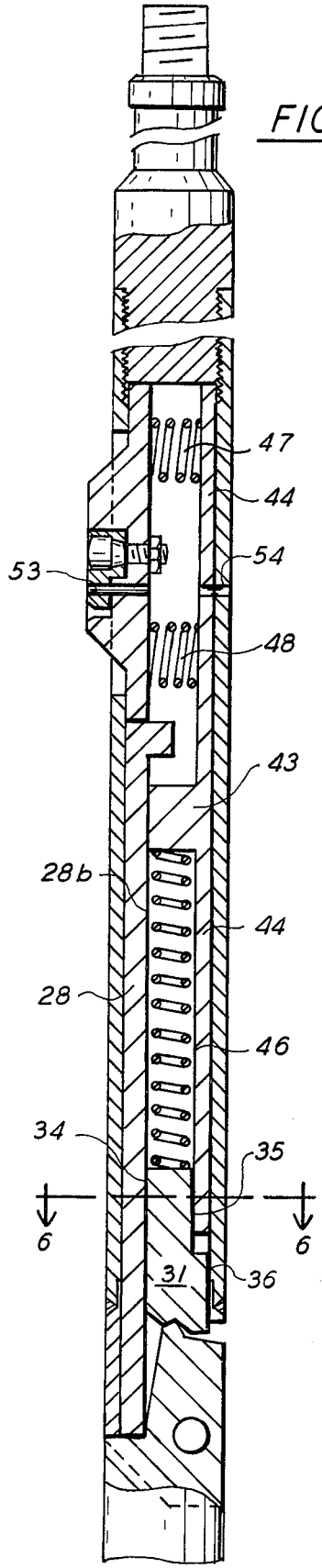
FIG. 3 is a view similar to FIG. 2 showing the tool carrier in a position in alignment with the remainder of the tool.

Referring now particularly to FIGS. 2 and 3, the housing 16 is elongate and is preferably tubular in form. The housing is suspended at its upper end from an upper sub 22 which may be connected to a conventional wireline or to a pumpdown locomotive or any desired means for running and pulling the kickover tool. The housing includes at its lower end a short section 23 welded thereto which supports the tool carrier 17 on a pivot 24. As seen best in FIG. 2 and FIG. 5, the housing section 23 has a vertical slot 25 therein. The pivot pin 24 traverses this vertical slot and the upper section of the tool carrier 17 is mounted on the pivot 24 for swinging movement within the slot 25 between the positions shown in FIGS. 2 and 3.

The downwardly facing surface 26 on the housing section 23 may act as a stop to limit swinging movement of the tool carrier in a direction away from its kicked-over position to its aligned position, as shown in FIG. 3, by engaging the upwardly facing surface 27 on the tool carrier 17.

Figure 5:
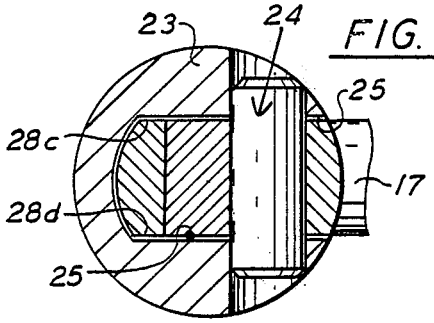
FIG. 5 is a view in section along the lines 5—5 of FIG. 2.
Figure 6:
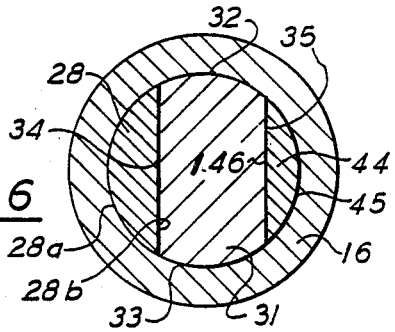
FIG. 6 is a view in section along the lines 6—6 of FIG. 3.

An actuator 28 is reciprocably mounted within the housing 16 for moving the tool carrier from its aligned to its kicked-over position. As shown in FIG. 6, the actuator 28 has an arcuate surface 28*a* to mate with the bore wall in the housing 16 and an opposing flat surface 28*b*. At the lower end of the actuator 28 the portion of the actuator which extends into the slot 25 within housing section 23 is also cut away on its opposing sides 28*c* and 28*d* to permit the lower end of the actuator to fit within the housing slot 25 and to reciprocate therein (FIG. 5). The lowermost end of the actuator 28 may bear against the upwardly facing shelf 27 on the tool carrier and when the actuator 28 is held against movement and the housing is moved upwardly relative to the actuator, this relative movement results in the tool carrier 17 being moved to kicked-over position as shown in FIG. 2.

At the upper end of the actuator an inwardly extending flange 29 is provided for purposes which will appear hereinafter.

A single two-position detent is provided to releasably hold the tool carrier in either the aligned or kicked-over position relative to the housing. This detent, in the form illustrated, includes the plunger 31 which, as shown in FIG. 6, has opposing arcuate surfaces 32 and 33 to mate with and slide along the internal bore wall of the housing 16. At its upper end the plunger has opposed flats 34 and 35. At its lower section the plunger also has an arcuate section 36 (FIG. 3) below the flat 35 so that at the lower portion of the plunger the sections 32, 36 and 33 of the plunger are a single continuous cylindrical surface interrupted by the flat 34.

The opposing flat surfaces 28*c* and 28*d* on the lower end of the actuator in cooperation with the slot 25 in lower body section 23 maintain the actuator in the orientation illustrated in the drawings. The confronting flat 28*b* on the actuator and flat 34 on the plunger, in like manner, maintain the plunger in the orientation illustrated in the drawings.

In order to provide for the two-position detent, the confronting faces of the plunger 31 and the tool carrier 17 are provided with opposing configurations that will detent the tool carrier in either of its aligned or kicked-over position. These opposing detent surfaces may take any desired form. They are preferably inclined or wedged surfaces which can be extended at desired angles to control the amount of force necessary to move the plunger 31 upwardly.

Preferably, the detent surfaces are provided by a downwardly extending tooth formed by the inclined surface 37 and 38 on the plunger.

The portion of the two-position detent on the tool carrier is provided by a tooth formed by inclined surfaces 39 and 41. Surfaces 39 and 38 are complementary, as are surfaces 37 and 41 in the preferred form.

It will be noted that surfaces 37 and 41 form a lesser angle with the center line of the tool than do surfaces 38 and 39. This is preferred to require a larger force to move the tool carrier from kicked-over to aligned position so that the tool carrier will tend to remain in the kicked-over position during pulling of a valve until the valve has left the valve pocket 15 so that the valve will remain parallel to the housing 16 while being pulled from the valve pocket.

A stop is provided and a spring 42 is held in compression between the stop and the upper end of the plunger 31 to provide a downward force on the plunger 31 to resist movement of the tool carrier between its aligned and kicked-over position. The stop could be carried by the actuator 38 or in any desired manner by the body 16, as the plunger only moves a very short distance. To avoid the effect of this slight movement of the plunger, however, it is preferred that the stop be carried by the body. It may be provided in any manner by a shelf within the body against which the spring 42 bears. In the preferred form, the stop 43 against which spring 42 bears is carried by an elongate segment 44 which is arcuate at 45 to mate with the bore through the body 16 and is flat at 146 to provide a sliding engagement with the surface 35 of the plunger 31. This flat engagement will maintain the stop carrier 44 in the orientation shown in the drawings. It will be appreciated that the stop 43 could be attached directly to the body 16, if desired. It will further be appreciated that the degree of compression of spring 42 could be changed by using different size springs, by varying the position of the stop 43 relative to the housing 16 or providing and adjusting means between the stop 43 and the spring 42. In most cases the spring force needed in a particular size and design of tool will be constant and a fixed stop, such as shown at 43, may be utilized.

It will be appreciated that any desired form of actuator key, such as that shown in the Goode patent, could be carried by the actuator 38 to cause reciprocation between the housing and the actuator. However, where the tool is to be used in conjunction with a side pocket mandrel having a muleshoe 13 to align the tool with the side pocket the locator key illustrated in the drawings is preferred as this key will only engage a muleshoe and will not hang in the well upon engaging a downwardly facing shoulder.

The locator key 46 is provided with a boss 46*a* thereon which extends radially outwardly beyond the outer diameter of the housing 16. This key rests upon and is supported on the flange or ledge 29 of the actuator and is urged to extended position by a pair of spaced springs 47 and 48 which extend between the key 46 and the stop carrier 44. Preferably, the parts are dimensioned so that when the tool carrier is in the aligned position shown in FIG. 3, the actuator 28 rests on the tool carrier and the key extends between the shelf 29 and the lower end of the upper sub 22. A slight clearance may be provided in this dimensioning to be certain that the tool carrier can move to full aligned position, as shown in FIG. 3.

The boss 46*a* is provided with an upwardly and inwardly inclined chamfer 46*b* and a downwardly and inwardly inclined chamfer 46*c* at its upper and lower surfaces, respectively. As the tool is moved vertically within the tubing any obstructions engaged by the surfaces 46*b* and 46*c* will cause the locator key to move inwardly against the force of springs 47 and 48 to move into a retracted or out of the way position, except when a muleshoe is encountered. Thus, the tool cannot be actuated or cannot hang up on any shoulder in the well when moving in either direction other than the shoulder provided by a muleshoe orienting surface.

When the key boss 46*a* engages a muleshoe, it causes the tool to rotate within the tubing to orient the tool carrier for movement into the side pocket 14 in the conventional manner.

To provide for arresting upward movement of the key 46 and thus the actuator 28, the key is provided with a means for engaging the orienting surface of the muleshoe to thus arrest movement of the key. In the illustrated form a lug 49 is pivoted to the key 46 by pin 51. The boss 46*a* has a deep recess 52 and a shallow recess 52*a* for receiving the lug and it will be apparent from FIGS. 2 and 3 that the lug does not project radially outwardly beyond the boss 46*a*.

A releasable means is provided for holding the key in a nonaligned position relative to the boss 46*a*. Thus, by reference to FIG. 4 the boss 46*a* has spaced side walls 46*d* and 46*e* which extend vertically and are substantially parallel so that they may enter into the slot within the muleshoe 13 to cooperate therewith and retain the kickover tool in proper orientation during downward movement of the kickover tool after it has been moved to the kickover position.

Figure 4:
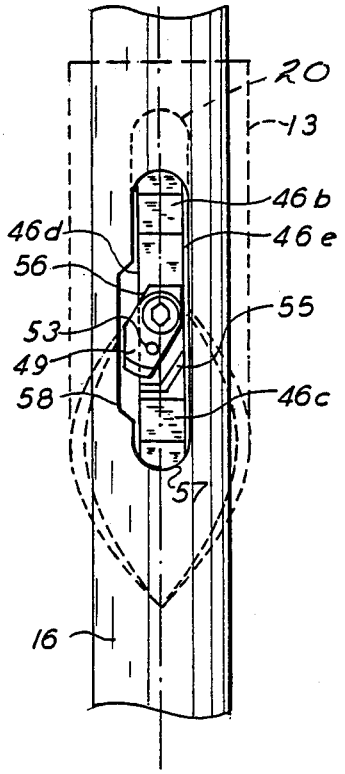
FIG. 4 is an elevational view of a portion of the kickover tool illustrating the locator key and showing the muleshoe which provides for orientation of the kickover tool and a stop for the key in phantom.

The lug 49 is pinned as indicated above in a nonaligned position relative to the side walls 46*d* and 46*e* of boss 46*a*. That is, in a position where the lug will engage the spiral downwardly facing surface of the muleshoe 13 and cannot enter the muleshoe slot, as shown in FIG. 4.

Any desired releasable means may be utilized to hold the lug in nonaligned position, such as the shear pin 53. To redress the tool a hole 54 extends through the housing and the stop carrier 44 at a point opposite the shear pin so that the shear pin may be punched out of the orienting key and the lug and a new shear pin inserted.

It is preferred that the lug 49 be limited in its swinging movement about the pivot 51 so that under no circumstances can it hang against an obstruction in the well after the shear pin 53 has been sheared. For this purpose it will be seen from FIG. 4 that the recess 52*a* within the boss 46*a* is provided with a stop surface 55 which limits movement of the lug in a counterclockwise direction, as viewed in FIG. 4 beyond substantially the aligned position relative to the boss 46*a*.

In like manner the recess 52 is provided with a surface 56 which engages the lug at approximately its position when pinned to the key by the shear pin 53 and after the pin 53 is sheared, this surface 56 limits movement of the lug 49 in a clockwise direction. Thus, the lug is held in its rotary movement between approximately the pinned position and the aligned position in the preferred form so that it is incapable of swinging to a position in which it might interfere with withdrawing the tool from the tubing after the pin 53 has been sheared. It is obvious that a greater arc than permitted by these stop surfaces could be utilized and still protect the tool against the lug causing problems during retrieval of the tool, but surfaces positioned as described are preferred.

As shown in FIG. 4 the slot 57 in the side wall of the housing in which the locator key 46 resides has an enlarged section 58 to permit the lug 49 to retract along with the key 46 into the housing as the key strikes obstructions in the well other than the muleshoe.

In operation the kickover tool is made up on a wireline or on a pumpdown locomotive in the conventional manner. Either a running sub and a valve are provided on the tool or a retrieving sub is provided and the tool is run into the well to a point below the side pocket mandrel in which the valve is to be landed or retrieved. The kickover tool is moved upwardly until the upwardly facing surface 46*b* of the locator key 46 engages the muleshoe 13 and travels around its orienting surface to orient the kickover tool for proper insertion or removal of a valve. As the locator key moves into the slot 20 above the orienting surface of the muleshoe, the lug 49 will move to the position shown in FIG. 4 and will arrest further upward movement of the locator key 46. Continued movement of the housing 16 will move the housing and tool carrier 17 upwardly relative to the actuator 28 resulting in the detent plunger 31 being moved upwardly by the interaction of surfaces 38 and 39 and the tool carrier 17 to move to its kickover position, as shown in FIG. 2. As shown in FIG. 2, the internal surface of the upper end of the tool carrier 17 may move against the actuator 28 to limit movement of the tool to the kickover position illustrated. While this is preferred, this engagement need not be provided and the engagement of the tool carrier against the wall of the side pocket 14 may be relied upon to limit the degree of movement of the tool carrier 17 to the kickover position.

With the tool carrier 17 in the kickover position the surfaces 37 and 41 on the detent plunger 31 and the tool carrier 17 are engaged and latch the tool carrier in the kickover position. Due to the relatively small angle that these surfaces make with the center line of the housing, a substantial force is needed to force the plunger 31 upwardly against the force of spring 42 and the kickover tool will be held in its kickover position while a valve is being landed or retrieved from the pocket 15.

After a valve is landed or when retrieving after a valve is engaged, the kickover tool is moved upwardly and the lug 49 will again engage the muleshoe 13. A strong upward force exerted on the tool results in shearing of the pin 53 permitting the lug to move to an aligned position in which it disengages the muleshoe and permits the tool to move upwardly. The upper end of the slot of many muleshoes has a downwardly facing shoulder but the upper chamferred surface 46*b* on the key will engage the shoulder and cause the locator key to move inwardly and pass upwardly through the muleshoe.

As the tool moves upwardly the tool carrier will engage the side wall of the tubing or the muleshoe, as illustrated in FIG. 1, and continued upward movement of the kickover tool will force the tool carrier to its aligned position. In doing so the detent plunger 31 will be moved upwardly to release the surfaces 37 and 41 and the detent surfaces 38 and 39 will come into engagement holding the tool carrier in its aligned position as the tool is retrieved from the hole.

The foregoing disclosure and description of the invention is illustrative and expanatory thereof and various changes in the size, shape and materials, as well as in the details of the illustrated construction, may be made within the scope of the appended claims without departing from the spirit of the invention.

What is claimed is:

1. A kickover tool comprising, an elongate housing, a tool carrier pivoted to said housing, an actuator reciprocably mounted relative to said housing, a locator key reciprocably mounted relative to said housing and associated with said actuator, said key when arrested in movement effecting relative movement between said housing and actuator upon continued movement of said housing and rotation of said tool carrier to kicked-over position, and a single two-position detent having two cooperative parts, each part containing two detent surfaces each of which alternately abuts the two detent surfaces of the other part and releasably holds said tool carrier in either aligned or kickover position relative to said housing.

2. The kickover tool of claim 1 wherein the detent is carried by said housing.

3. The kickover tool of claim 1 wherein;

the two-position detent is provided by a shoulder carried by the housing, a plunger reciprocable relative to the housing, and a spring compressed between the shoulder and plunger;

the plunger has a downwardly facing tooth thereon;

and the tool carrier has an upwardly facing tooth thereon engaging the plunger tooth.

4. The kickover tool of claim 3 wherein, stop means on the tool carrier and one of the housing and plunger limits pivoting of the tool carrier away from kickover position to a position axially aligned with said housing.

5. The kickover tool of claims 1, 2, 3 or 4 wherein, the locator key has a longitudinally extending boss having spaced side walls projecting outwardly from the exterior of said housing, the locator key is urged outwardly of said housing by resilient means, a lug is pivotally carried by said boss, and releasable means holds said lug in nonaligned position in which said lug projects beyond one side wall of said boss, said lug when released being not wider than said boss and free to move into alignment therewith.

6. The kickover tool of claim 5 in which cooperable means on said boss and said lug limits rotation of said lug between approximately its position when held in nonaligned position and its aligned position.

7. A kickover tool comprising, an elongate housing, a tool carrier pivoted to said housing, an actuator reciprocably mounted relative to said housing, a locator key reciprocably mounted relative to said housing and associated with said actuator, said key when arrested in movement effecting relative movement between said housing and actuator upon continued movement of said housing and rotation of the said tool carrier to kicked-over position, said actuator key having a longitudinally extending boss having spaced side walls projecting outwardly from the exterior of said housing, said locator key being urged outwardly of said housing by resilient means, a lug pivotally carried by said boss, and releasable means holding said lug in nonaligned position in which said lug projects beyond one side wall of said boss, said lug when released being not substantially wider than said boss and free to move into alignment therewith.

8. The kickover tool of claim 7 in which cooperable means on said boss and said lug limit rotation of said lug between approximately its position when held in nonaligned position and its aligned position.

* * * * *